United States Patent [19]

Evans

[11] Patent Number: 4,981,029

[45] Date of Patent: Jan. 1, 1991

[54] ELECTRIC HEATER COIL ASSEMBLY TERMINATION APPARATUS AND METHOD OF USE

[75] Inventor: Arthur Evans, Sherburne, N.Y.

[73] Assignee: Carrier Corporation, Syracuse, N.Y.

[21] Appl. No.: 457,230

[22] Filed: Oct. 26, 1989

[51] Int. Cl.[5] ..... B21F 35/02; B21F 45/00

[52] U.S. Cl. ..... 72/134; 72/137; 140/71.5

[58] Field of Search ..... 29/173, 611; 72/133, 72/134, 135, 137; 140/71.5, 89, 92.9, 103

[56] References Cited

U.S. PATENT DOCUMENTS

| | | | |
|---|---|---|---|
| 2,693,204 | 11/1954 | Greiner et al. | 140/71.5 |
| 2,759,498 | 8/1956 | Mann et al. | 140/71.5 |
| 2,968,323 | 1/1961 | Wolf | 140/71.5 |
| 3,670,377 | 6/1972 | Michael | 140/71.5 X |
| 4,807,488 | 2/1989 | McManus | 29/611 X |
| 4,813,126 | 3/1989 | Williamson | 72/137 X |

*Primary Examiner*—E. Michael Combs

*Attorney, Agent, or Firm*—Robert H. Kelly

[57] ABSTRACT

A method and apparatus for forming an electric resistance heating coil of desired resistance that involves forming a straight end or pigtail at the ends of the coil whereby electrical connectors can be connected to the aligned pigtails and end insulators can separate the electrical connectors.

4 Claims, 2 Drawing Sheets

ELECTRIC HEATER COIL ASSEMBLY TERMINATION APPARATUS AND METHOD OF USE

BACKGROUND OF THE INVENTION

This invention relates generally to electric resistance heating coil assemblies, and more particularly to a method and apparatus for straightening and terminating the helical ends of coil assembly in an end insulator and electrical connectors, after forming lengths of coils of desired dimensions and resistance, centering the formed coils for transfer to a first folding station, folding the centered coil into a U-shaped helical coil, and attaching the U-shaped coil to a support rack and insulators to form the coil assembly. During manufacture, electrical resistance space heating coil assemblies of the type employing a coiled resistance element require various forming, moving, manipulating, and checking steps. Straight wire is formed into a helical coil, configured into a desired shape, secured to an insulated support rack, lugged with electrical connectors, and inspected for proper insulation and resistance characteristics. Commonly assigned U.S. Pat. No. 4,528,441 discloses different insulator designs and a scheme for manually securing the coil to the insulators. The scheme, however, was only suited for hand assembly and required manual manipulation for each attachment as the coil was wrapped around the support rack and the insulators deformed the coil to achieve attachment. Commonly assigned U.S. Pat. Nos. 4,807,488 and 4,827,602 disclose a method and apparatus for automatically installing a coiled heater element onto insulators. To date, however, there has been no equipment or apparatus which permits the efficient forming, folding, moving, manipulating, and terminating to be done efficiently and automatically without damage to the assembly. In terminating the end windings of the assembly coil with electrical connectors, there is a potential for misalignment of the ends of the coil and stretching or deforming the coil, so that when the electrical connectors are affixed to the coil assembly the connectors are misaligned and the resistance of the assembly has changed causing the completed coil assembly to be rejected. No apparatus has been proposed that permits a formed electric resistance heating coil assembly with helical end winding portions to have the end winding portions straightened into "pigtails" or straight ends and terminated with electrical connectors and end insulators.

Coils have been formed with a desired diameter and pitch using wire of a known diameter to form an electrical coil of required resistance. After a coil winder has formed a coil, the formed coil is centered and moved to a folding station where the coil length is formed into a U-shaped coil with a short base length and two leg lengths. After the coil is folded into the U-shape it is again moved to a coil/rack assembly station to fix the coil to insulators of a rack. After the coil is assembled on the rack the helical ends of the coil must be straightened and aligned parallel with the legs of the coil and terminated with connectors.

Thus, there is a clear need for an apparatus and method for straightening the end windings of a coil into a pigtail and attaching lugs or electrical connectors to the pigtails without damaging the coil.

SUMMARY OF THE INVENTION

It is an object of the present invention to manufacture electrical resistance heating coil assemblies of desired length, diameter, and resistance while avoiding the draw backs of the prior art.

It is a further object of the present invention to provide a method and apparatus for terminating formed helical coil assemblies of different diameters, pitches, lengths and wire sizes with electrical connectors and end insulators.

It is another object of the present invention to provide a method and apparatus which will locate a pigtail at the end of a coil assembly that is generally parallel to the axis of the leg portions of the coil assembly.

These and other objects of the present invention are obtained by means of forming pigtails on the ends of electric resistance heating coil assembly coils while maintaining pigtail alignment generally parallel to the coil axis, and terminating the pigtails with electric connectors while separating the pigtails with end insulators.

The various features of novelty which characterize the invention are pointed out with particularity in the claims annexed to and forming a part of the specification. For a better understanding of invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification and which reference numerals shown in the drawing designate like or corresponding parts throughout the same, and in which.

DESCRIPTION OF THE PREFERRED EMBODIMENTS

Figure 1:
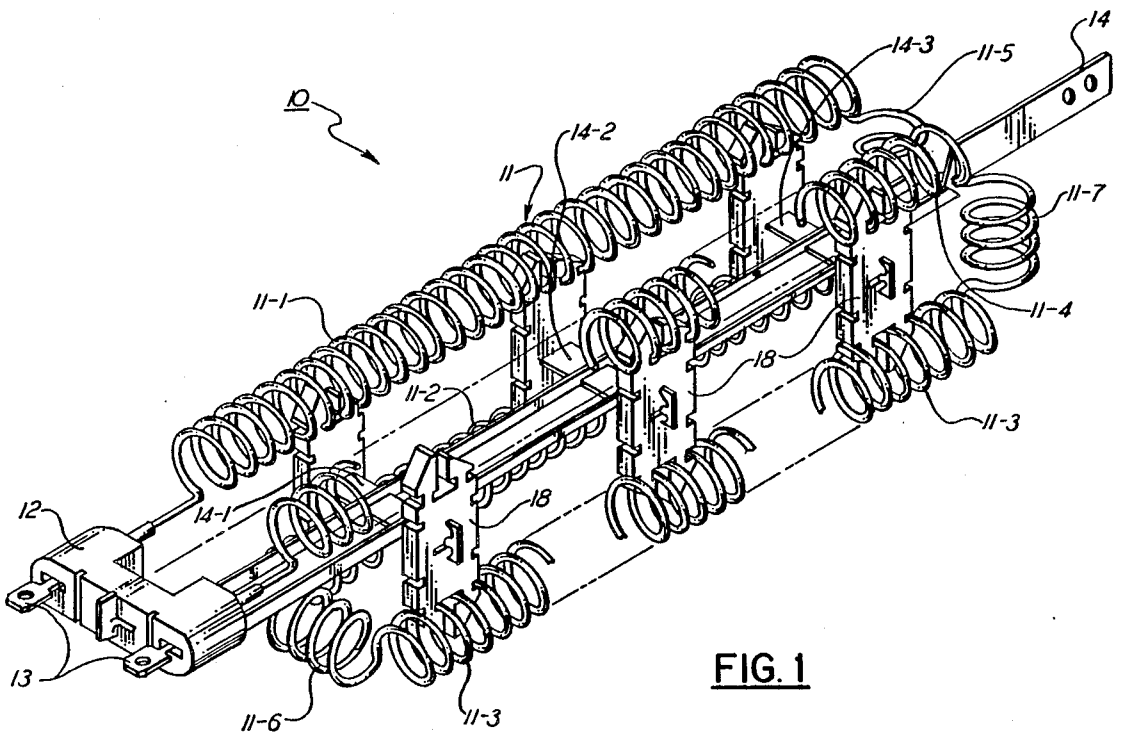
FIG. 1 is a perspective view of an assembled electrical resistance heating coil completely terminated with connectors and an end insulator according to an embodiment of the present invention.
Figure 2:
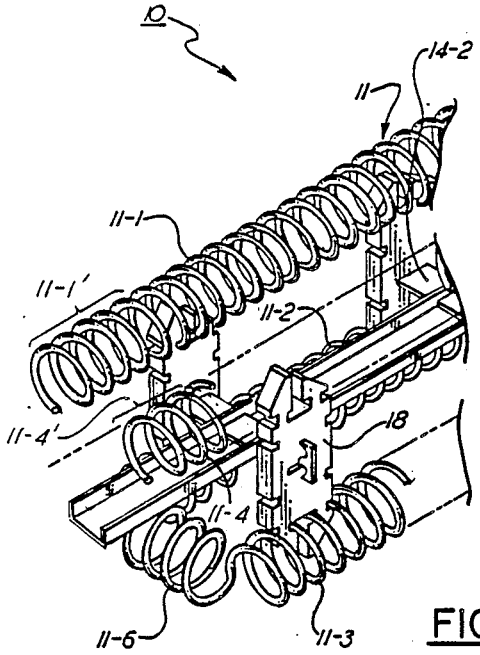
FIG. 2 is a partial view of a coil assembly after assembly to a rack but prior to straightening and terminating with electrical connectors.
Figure 3:
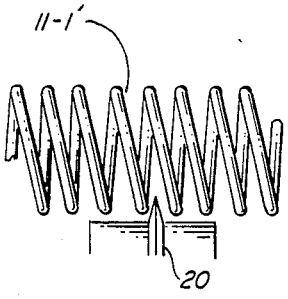
FIGS. 3–6 sequentially show the pigtail forming of the present invention.
Figure 4:
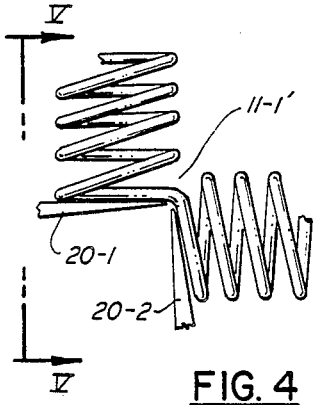

In FIG. 1, the numeral 10 generally designates a completed electric resistance heating coil assembly. The wire coil 11 is made up of four (4) long legs or branches 11-1 through 11-4 connected by short legs or branches 11-5 through 11-7 and terminates branches 11-1 and 11-4 in spade lugs or electric connectors 13 separated by an end insulator block 12. Coil 11 is supported on a tree or rack 14 by a plurality of ceramic insulators 18 which are located on the ends of branches 14-1 through 14-3 of the rack. FIG. 2 show the completed coil assembly of FIG. 1, but with the ends of branches 11-1 and 11-4 still being helically wound and not insulated or terminated in electric connectors.

In an electrical resistance space heating assembly the length, diameter, pitch, and end termination or pigtail of the helically formed coil is critical in determining the desired resistance of the heating coil. In these heating assemblies adjacent coil windings must have proper spacing along the entire length of the coil, including the folds, to insure that the coil does not short-out and that both ends terminate in generally the same transverse plane parallel to this longitudinal axis of the long legs of the coil. The sequential steps, i.e. a helical coil parallel to a longitudinal axis, for straightening the helical ends of a straight length of helical coil into straight ends or pigtails are illustrated, with particular reference to branch 11-1 in FIGS. 2–8. The key elements in the straightening process are a folding blade device 20 and a pulling or straightening apparatus 30 which folds a portion of helical ends 11-1' and 11-4' at a 90° angle to the axis of the branches 11-1 and 11-4 and straightens the folded end portion so that it is parallel to the longitudinal axis of the branches 11-1 and 11-4.

Figure 5:
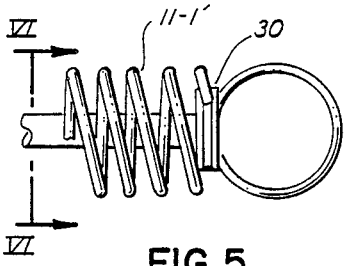
Figure 6:
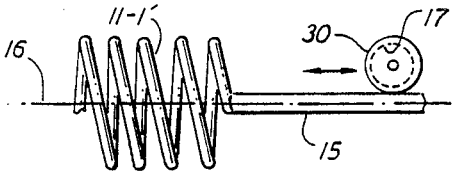

In the folding operation rotating split blade 20, including blade 20-1 and 20-2, is positioned between adjacent windings of end portion 11-1'. Blades 20-1 and 20-2 rotate with respect to each other from the FIG. 3 position to the FIG. 4 position, wherein both figures are shown as top plan views. After rotating split blade 20 has moved a portion of end portion 11-1' through an angle of 90°, a pulling apparatus 30 is inserted longitudinally into the end of the folded coil as illustrated in FIG. 5 and is moved away from branch 11-1 along the longitudinal axis 16 of branch 11-1 as illustrated in FIG. 6 to form a pigtail 15 at the end of branches. FIG. 5 is a front elevation of FIG. 4, while FIG. 6 is a side elevation of FIG. 5. Pulling apparatus 30 may be a wheel-like device with a circumferential groove 17 which coacts with the wire of the coil 11 to straighten the helical wire as the pulling device move parallel to the axis 16. It will be noted that the pigtail 15 is generally parallel to and coaxial with the longitudinal axis 16 of the branches 11-1 and 11-4, thus providing straight wire ends which can be lugged with electrical connectors and separated by end insulators to form a completed electric resistance heating coil assembly 10 as shown in FIG. 1.

While a preferred embodiment of the present invention has been depicted and described, it would be appreciated by those skilled in the art that many modifications, substitutions, and changes, may be made thereto without departing from the true spirit and scope of the invention.

What is claimed is:

1. An apparatus for forming straight wire ends from a plurality of windings on end portions of a straight helical length of electrical resistance heating coils for connecting electrical connector thereto comprising;

folding means insertable between adjacent windings of the end portion of the helical electrical resistance coil for rotating the plurality of windings of the end portion through an angle generally equal to ninety degrees of rotation with respect to a longitudinal axis of the straight helical length of electric resistance heating coil, and straightening means for forming said rotated end portion having the plurality of windings into a straight length of resistance wire whereby said formed straight length of resistance wire is generally parallel to the longitudinal axis of the straight helical length of electrical resistance heating coil.

2. An apparatus as set forth in claim 1 wherein said folding means comprises a pair of separable blades movable with respect to each other for moving adjacent windings of the end portion away from each other in an angular direction.

3. An apparatus as set forth in claim 2 wherein said straightening means comprises a wheel-like device matingly engagable with said rotated end portion and movable in a direction generally parallel to the longitudinal axis of the straight helical length of electric resistance heating coil.

4. A method of forming straight wire ends from a plurality of windings on end portions of a straight helical length of electrical resistance heating coils for connecting electrical connector thereto comprising the steps of:

rotating a plurality of adjacent windings of the end portion of the helical electrical resistance coil through an angle generally equal to ninety degrees of rotation with respect to a longitudinal axis of the straight helical length of electric resistance heating coil, and forming the plurality of windings of said rotated end portion into a straight length of resistance wire whereby said formed straight length of resistance wire is generally parallel to the longitudinal axis of the straight helical length of electric resistance heating coil.

* * * * *